US008251153B1

(12) United States Patent
Long et al.

(10) Patent No.: US 8,251,153 B1
(45) Date of Patent: Aug. 28, 2012

(54) CONTROL LINE FEED THROUGH CLAMP

(75) Inventors: Rodney Wayne Long, Cypress, TX (US); Charles David Wintill, Houston, TX (US); William John Darnell, Houston, TX (US); William Ryle Darnell, St. Martinville, LA (US); Michael Chad Darby, Katy, TX (US)

(73) Assignee: Petroquip Energy Services, LLP, Houston, TX (US)

( * ) Notice: Subject to any disclaimer, the term of this patent is extended or adjusted under 35 U.S.C. 154(b) by 57 days.

(21) Appl. No.: 12/820,651

(22) Filed: Jun. 22, 2010

(51) Int. Cl.
*E21B 19/00* (2006.01)

(52) U.S. Cl. ..... 166/382; 166/77.1; 166/93.1

(58) Field of Classification Search ..... 166/382, 166/385, 241.6, 77.1, 93.1, 75.13, 75.14; 294/102.2, 113, 114
See application file for complete search history.

(56) References Cited

U.S. PATENT DOCUMENTS

| | | | | |
|---|---|---|---|---|
| 1,552,062 | A * | 9/1925 | Krell | 188/67 |
| 2,163,932 | A * | 6/1939 | Bettis | 166/241.6 |
| 3,397,017 | A * | 8/1968 | Taylor, Jr. et al. | 175/325.7 |
| 4,004,326 | A * | 1/1977 | Beavers | 166/241.6 |
| 4,279,308 | A * | 7/1981 | Gray et al. | 166/382 |
| 4,478,278 | A * | 10/1984 | Klein | 166/105 |
| 5,379,836 | A * | 1/1995 | Jordan | 166/241.6 |
| 6,595,284 | B2 * | 7/2003 | Davis | 166/241.4 |
| 7,461,700 | B2 * | 12/2008 | Livingston, Jr. et al. | 166/379 |

* cited by examiner

*Primary Examiner* — Jennifer H Gay
*Assistant Examiner* — Catherine Loikith
(74) *Attorney, Agent, or Firm* — Buskop Law Group, PC; Wendy Buskop

(57) ABSTRACT

A clamping apparatus allowing a downhole line to be fed between downhole tubular members. The clamping apparatus can include a first and second half, each including: support arms with inner surfaces, connecting walls, and grips. The first and second halves can be selectively connectable. The clamping apparatus can include handles, hinges, and latches. A system for feeding a downhole line between an outer tubular member and an inner tubular member can include an outer tubular member disposed about an inner tubular member, wherein the clamping apparatus is disposed about the inner tubular member.

20 Claims, 6 Drawing Sheets

CONTROL LINE FEED THROUGH CLAMP

FIELD

The present embodiments generally relate to a clamping apparatus that allows a downhole line to be fed between tubular members.

BACKGROUND

A need exists for a clamping apparatus that allows a downhole line to be fed between two tubular members in a safe and efficient manner.

A further need exists for a clamping apparatus that supports one of the tubular members, while a downhole line is being fed between the tubular members.

The present embodiments meet these needs.

BRIEF DESCRIPTION OF THE DRAWINGS

The detailed description will be better understood in conjunction with the accompanying drawings as follows.

Figure 1:
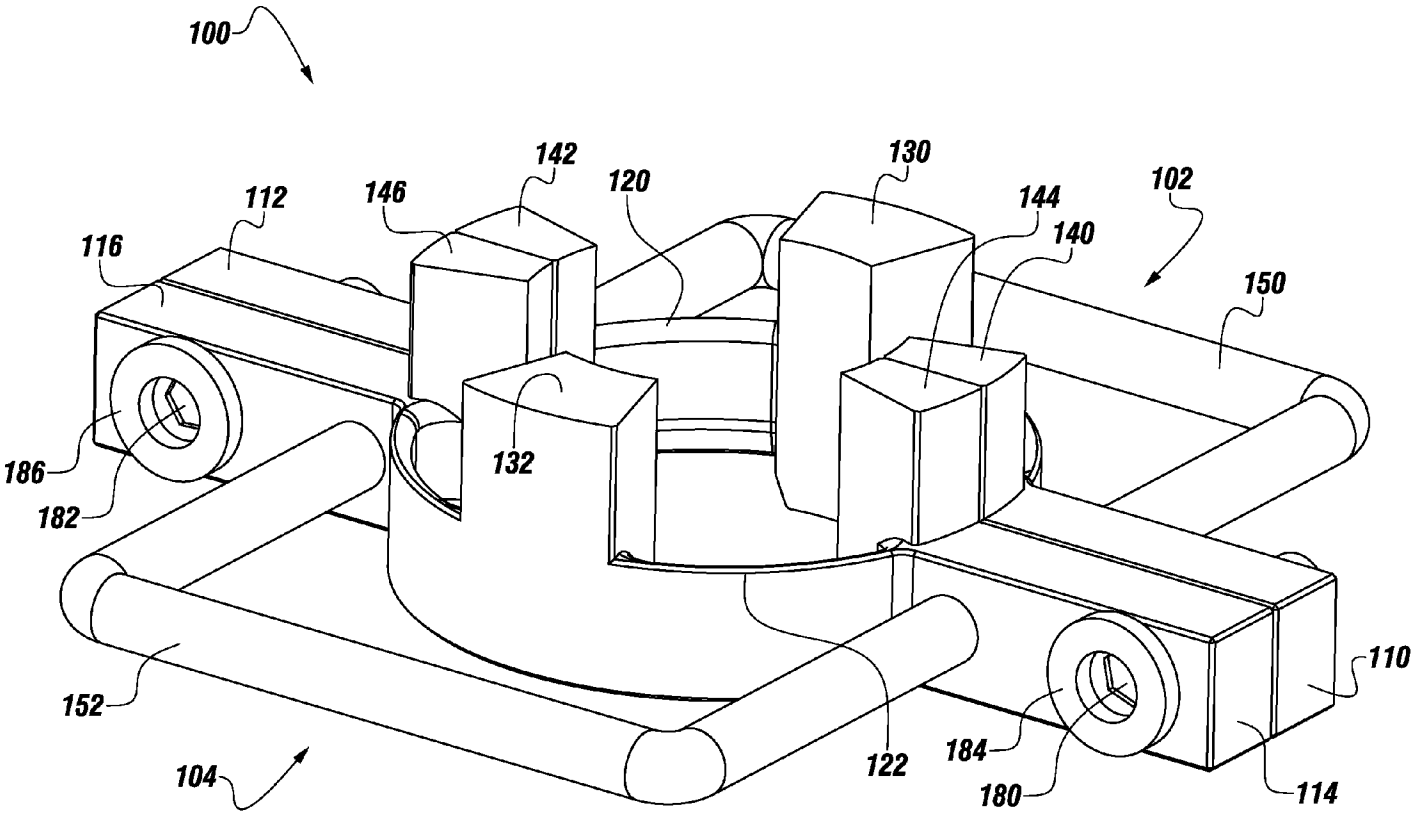
FIG. 1 is an isometric view of an embodiment of a clamping apparatus.

The present embodiments are detailed below with reference to the listed Figures.

DETAILED DESCRIPTION OF THE EMBODIMENTS

Before explaining the present apparatus and system in detail, it is to be understood that the apparatus and system are not limited to the particular embodiments and that the apparatus and system can be practiced or carried out in various ways.

The present embodiments generally relate to a clamping apparatus and a system for feeding downhole lines between tubular members.

A downhole line can be a fiber optic cable, a hydraulic line, an electrical line, a support line, a cable, a chain, a signal line, a fluid line, a pneumatic line, or another line used in downhole operations.

The clamping apparatus can have a clamping apparatus first half and a clamping apparatus second half. The clamping apparatus first half can have a first support arm having an inner surface and a second support arm having an inner surface.

The first support arm can be connected to the second support arm by a first connecting wall. The first connecting wall can have a radius of curvature. For example, the radius of curvature can be such that the first connecting wall can fit about a portion, such as a half, of a one inch outer diameter tubular.

The first connecting wall can have one or more segments connected together. The segments can be the same shape or a different shape from one another.

The connecting wall inner surface can have a first grip disposed thereon.

The clamping apparatus can include a clamping apparatus second half. The clamping apparatus second half can be connectable to the clamping apparatus first half. For example, the clamping apparatus first half can be connected to the clamping apparatus second half by one or more threaded fasteners.

In one or more embodiments, the clamping apparatus first half and clamping apparatus second half can be connected together by a hinge and latch. A hinge can connect a portion of the halves together, and a latch can be used to secure the other portion of the halves together.

The clamping apparatus second half can have a third support arm having an inner surface configured to mate with the first support arm inner surface. The clamping apparatus second half can have a fourth support arm having an inner surface configured to mate with the second support arm inner surface. The third support arm can be attached to the fourth support arm by a second connecting wall having the radius of curvature.

A second grip can be connected to a second connecting wall inner surface. The second connecting wall can be similar to the first connecting wall.

In one or more embodiments, each support arm can have a grip disposed thereon. A first support arm grip can be disposed on the first support arm. A second support arm grip can be disposed on the second support arm. A third support arm grip can be disposed on the third support arm, and a fourth support arm grip can be disposed on the fourth support arm.

One or more embodiments of the clamping apparatus can be used as part of a system for feeding a downhole line between an outer tubular member and an inner tubular member. The system can include the clamping apparatus secured about an inner tubular member and an outer tubular member disposed about the inner tubular member.

In one or more embodiments, the clamping apparatus can be disposed about a tubular member and can support an adjacent tubular member allowing for a downhole line to be fed between the tubular members.

The embodiments of the method can be better understood with reference to the Figures.

FIG. 1 is an isometric view of a clamping apparatus according to one or more embodiments. The clamping apparatus 100 can include a clamping apparatus first half 102 and a clamping apparatus second half 104. The clamping apparatus 100 can have one or more support arms (four are shown 110, 112, 114, and 116), one or more connecting walls (two are shown 120 and 122), one or more grips (two are shown 130 and 132), one or more support arm grips (four are shown 140, 142, 144, and 146), and one or more handles (two are shown 150 and 152).

The clamping apparatus first half 102 can include a first support arm 110 connected to a second support arm 112 by a first connecting wall 120. A first support arm grip 140 can be disposed on the first support arm 110. A second support arm grip 142 can be disposed on the second support arm 112.

The first support arm grip 140 can be welded, bolted, or otherwise connected to the first support arm 110 adjacent to the first connecting wall 120. The second support arm grip 142 can be connected to the second support arm 112 adjacent to the first connecting wall 120.

The clamping apparatus second half 104 can have a fourth support arm 116 connected to a third support arm 114 by a second connecting wall 122. A third support arm grip 144 can be disposed on the third support arm 114. A fourth support arm grip 146 can be disposed on the fourth support arm 116.

The third support arm grip 144 can be welded, bolted, or otherwise connected to the third support arm 114 adjacent to the second connecting wall 122. The fourth support arm grip 146 can be connected to the fourth support arm 116 adjacent to the second connecting wall 122.

The connecting walls 120 and 122 can have a radius of curvature. The radius of curvature can be such that each connecting wall can fit about a portion of a downhole tubular.

An inner surface of the first support arm 110 can mate with an inner surface of the third support 114, and an inner surface of the second support arm 112 can mate with a an inner surface of the fourth support arm 116. When the support arms 110, 112, 114, and 116 are mated with one another, the connecting walls 120 and 122, and the ends of the support arms 110, 112, 114, and 116 adjacent to the connecting walls 120 and 122 can form a substantially circular surface.

The clamping apparatus first half 102 and the clamping apparatus second half 104 can be secured to one another by one or more threaded fasteners (two are shown 180 and 182). A first threaded fastener 180 can attach the first support arm 110 and the third support arm 114 to one another. A second threaded fastener 182 can attach the second support arm 112 and the fourth support arm 116 to one another.

One or more fastener retainers (two are shown 184 and 186) can be used to keep the fasteners 180 and 182 from falling from the support arms when the clamping apparatus first half 102 and the clamping apparatus second half 104 are not secured together.

A first fastener retainer 184 can be used to keep the first threaded fastener 180 with the third support arm 114, and a second fastener retainer 186 can be used to keep the second threaded fastener 182 with the fourth support arm 116. Each fastener retainer 184 and 186 can be a washer, a cage, or another retaining device that allows access to the threaded fastener but prevents the threaded fastener from falling from the associated support arm.

A first handle 150 can be connected to the first support arm 110 and the second support arm 112. In addition, the clamping apparatus first half 102 can include a first grip 130 connected to an inner surface of the first connecting wall 120. A second handle 152 can be connected to the third support arm 114 and the fourth support arm 116. In addition, the clamping apparatus second half 104 can have a second grip 132 connected to an inner surface of the second connecting wall 122.

Figure 2:
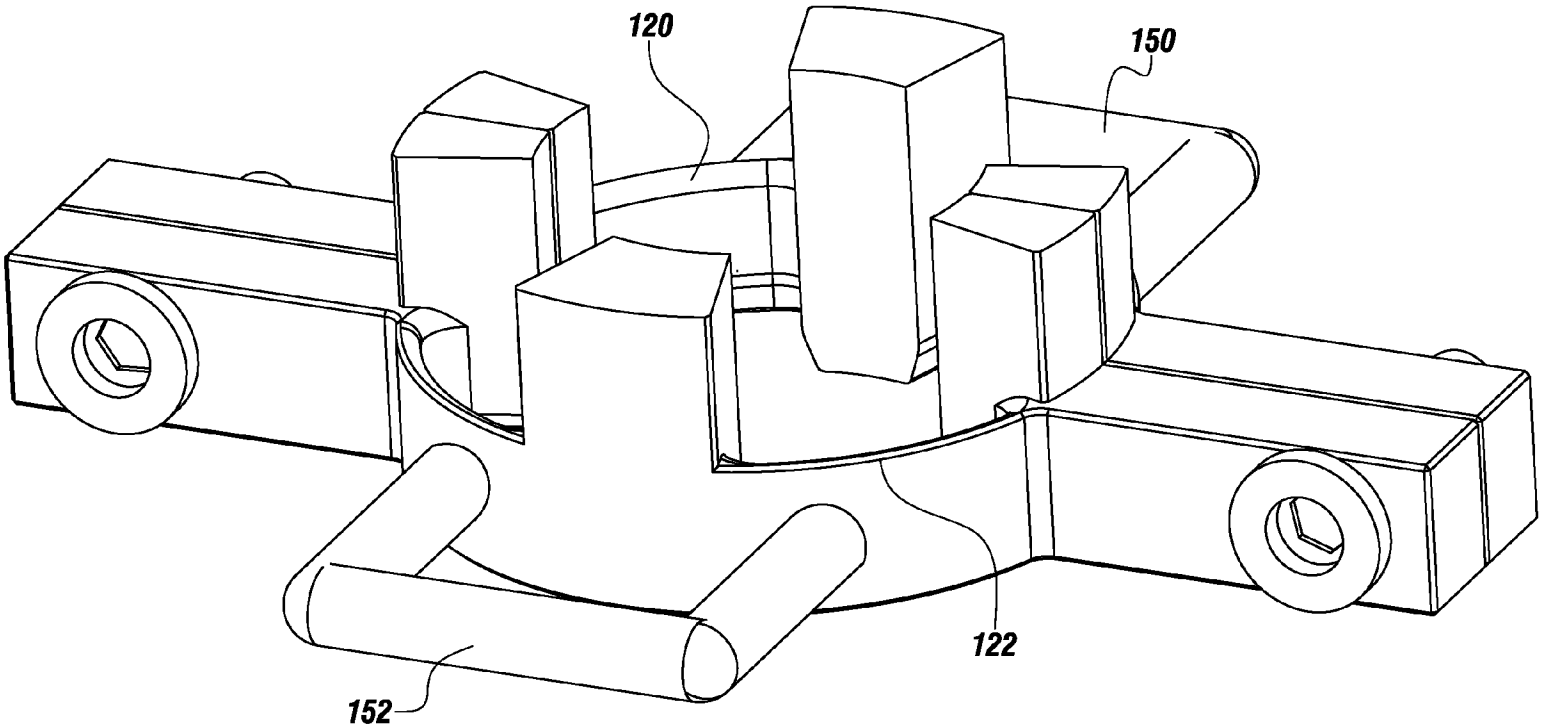
FIG. 2 depicts an isometric view of the clamping apparatus according to one or more embodiments.

In one or more embodiments, such as depicted in FIG. 2, the second handle 152 can be connected to the second connecting wall 122 and the first handle 150 can be connected to the first connecting wall 120.

Figure 3:
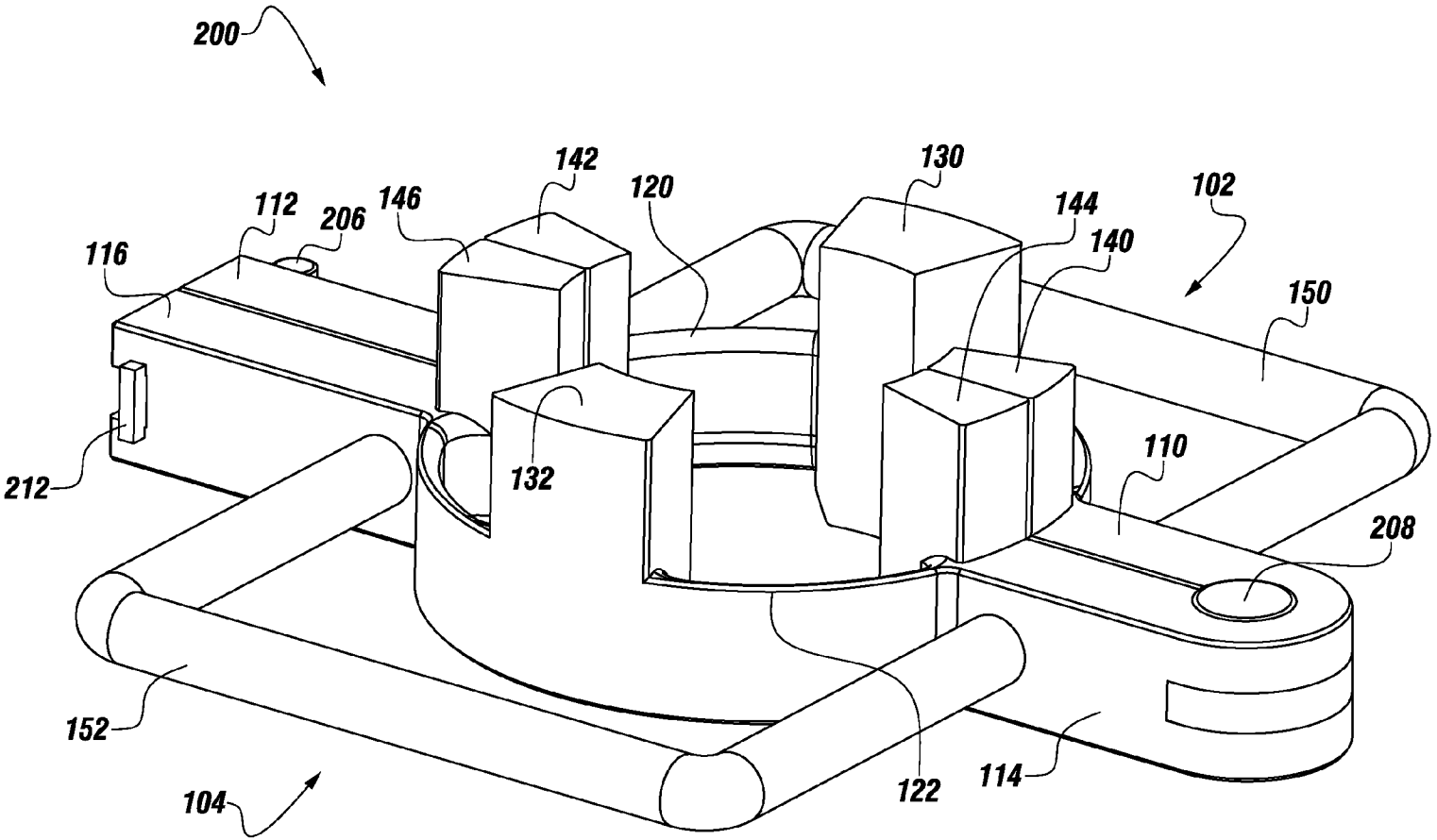
FIG. 3 depicts an isometric view of another embodiment of the clamping apparatus.

FIG. 3 depicts an isometric view of another illustrative embodiment of a clamping apparatus. The clamping apparatus 200 can be substantially similar to clamping apparatus 100, shown in FIG. 1. However, a portion of the clamping apparatus first half 102 can be hinged to a portion of the clamping apparatus second half 104.

A latch 206 can be used to selectively secure a portion of the clamping apparatus first half 102 to a portion of the clamping apparatus second half 104. One or more hinges 208 can connect the first support arm 110 to the third support arm 114.

The latch 206 can be disposed on the second support arm 112, and a latch receptacle 212 can be disposed on the fourth support arm 116. The placement of the latch receptacle 212 onto the fourth support arm 116 can be done by forming the latch receptacle 212 into the fourth support arm 116, welding the latch receptacle 212 to the fourth support arm 116, or otherwise placing the latch receptacle 212 on the fourth support arm 116.

Figure 4A:
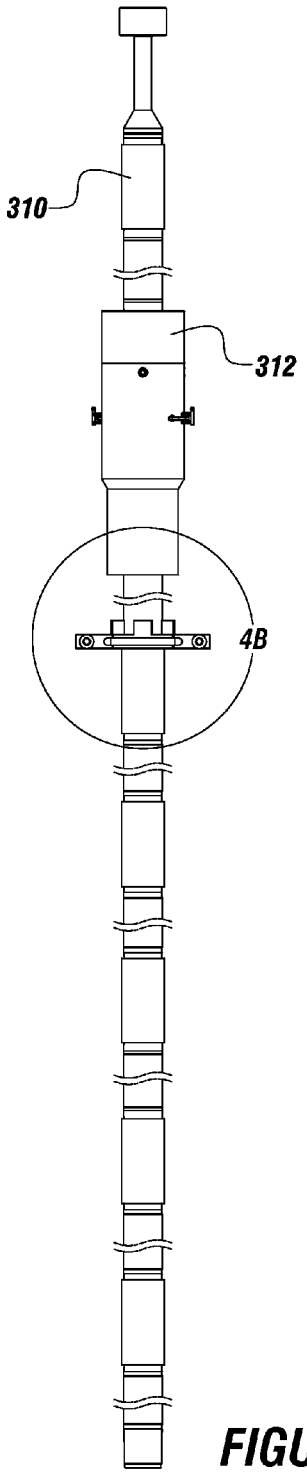
FIG. 4A depicts a schematic of a system for feeding a downhole line between two tubular members with an outer tubular member in a raised position.
Figure 4B:
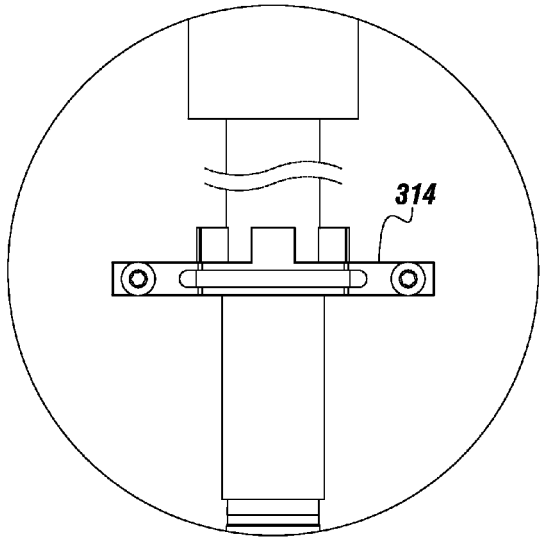
FIG. 4B depicts a detailed view of a portion of the system for feeding the downhole line between two tubular members with the outer tubular member in the raised position of FIG. 4A.

FIG. 4A depicts a schematic of a system for feeding a downhole line between two tubular members with the outer tubular member in a raised position. FIG. 4B depicts a detailed view of a portion of the system for feeding the downhole line between two tubular members with the outer tubular member in the raised position of FIG. 4A. Referring to FIGS. 4A and 4B, the system can include an inner tubular member 310 and an outer tubular member 312. The outer tubular member 312 can be disposed about the inner tubular member 310. The inner tubular member 310 can be a completion string or another downhole tubular. The outer tubular member 312 can be a shroud, a housing, a perforated tubing, or another downhole tubular member. A clamping apparatus 314 can be disposed about the inner tubular member 310. The clamping apparatus 314 can be substantially similar or the same as any of the clamping apparatus described herein.

Figure 5A:
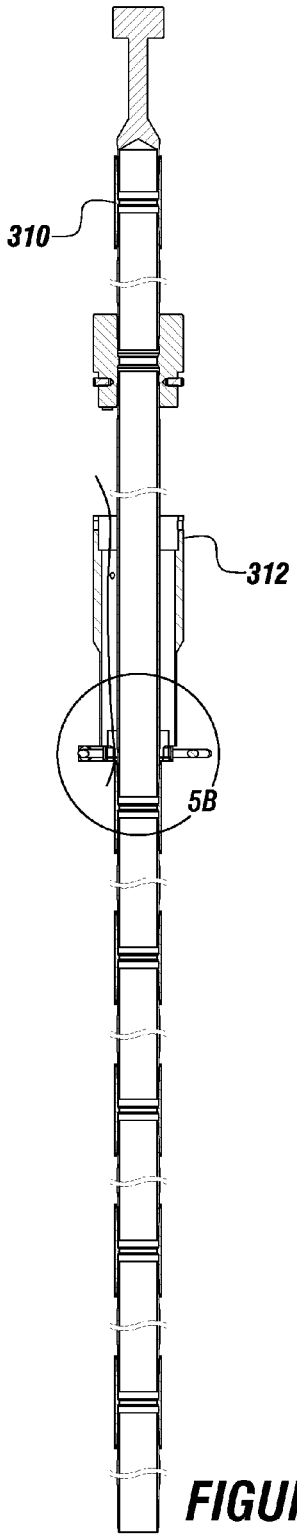
FIG. 5A depicts a schematic of the system of FIG. 4A wherein the outer tubular member is in a resting position and a downhole line is being fed through an inner tubular member and the outer tubular member.
Figure 5B:
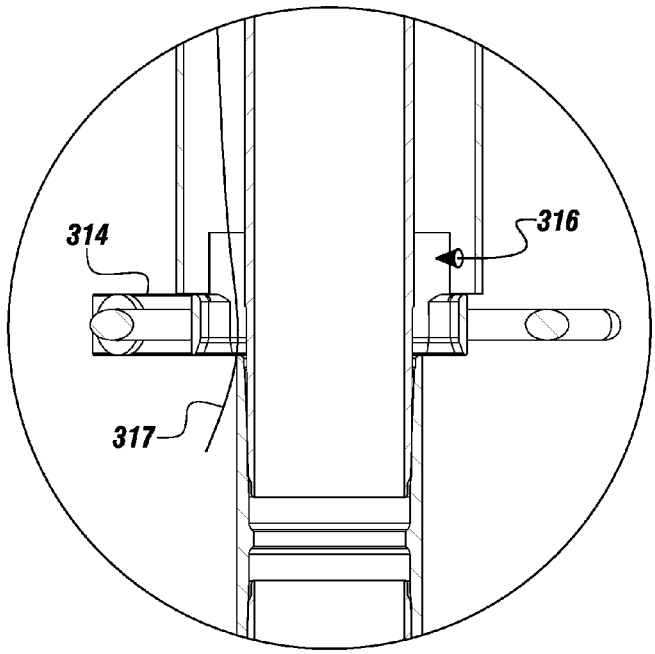
FIG. 5B depicts a detailed view of a portion of the system of FIG. 5 wherein the outer tubular member is in a resting position and a downhole line is being fed through an inner tubular member and the outer tubular member.

FIG. 5A depicts a schematic of the system of FIG. 4 wherein the outer tubular member 312 is in a resting position and a downhole line 317 is being fed between the inner tubular member 310 and the outer tubular member 312. FIG. 5B depicts a detailed view of a portion of the system of FIG. 5A wherein the outer tubular member is in the resting position and the downhole line is being fed through the inner tubular member and the outer tubular member. Referring to FIGS. 5A and 5B, the outer tubular member 312 can be lowered onto the clamping apparatus 314. The clamping apparatus 314 can support the outer tubular member 312. In addition, one or more channels 316 can be formed between the inner tubular member 310 and the inner diameter of the clamping apparatus 314.

The downhole line 317 can be fed between the clamping apparatus 314 and the inner tubular member 310 through a channel 316. The downhole line 317 can be connected to or placed in communication with one or more downhole tools (not shown). The downhole tool can be a tubing hanger, a sliding sleeve, a sensor, a pump, or another downhole equipment.

Figure 6:
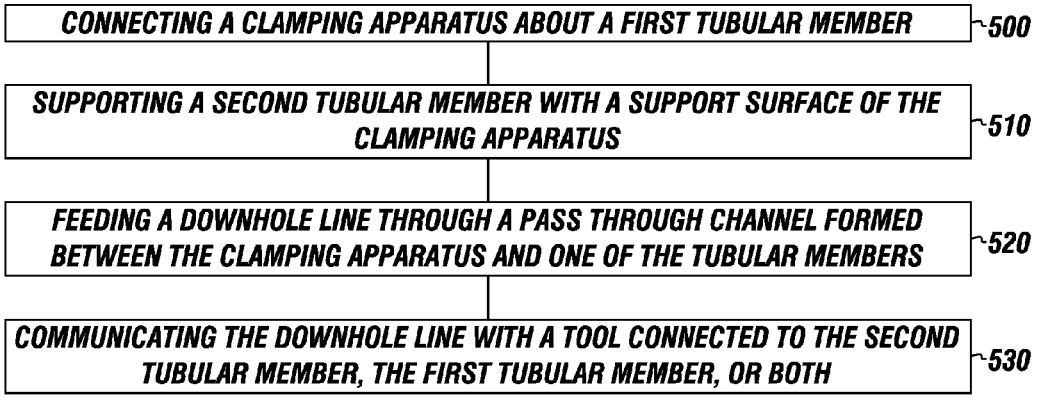
FIG. 6 depicts a flow diagram of a method for using the clamping apparatus to feed 5 a downhole line between two tubular members according to one or more embodiments.

FIG. 6 depicts a flow diagram of a method for using the clamping apparatus to feed downhole lines between two tubular members according to one or more embodiments.

The method for feeding downhole lines between two tubulars can include connecting a clamping apparatus about a first tubular member, as depicted at box 500.

At box 510, the method can include supporting a second tubular member with a support surface of the clamping apparatus.

The method can include feeding a downhole line through a pass through channel formed between the clamping apparatus and one of the tubular members, which is depicted at box 520.

In addition, the method can include communicating the downhole line with a tool connected to the second tubular member, the first tubular member, or both, as depicted in box 530.

While these embodiments have been described with emphasis on the embodiments, it should be understood that within the scope of the appended claims, the embodiments might be practiced other than as specifically described herein.

What is claimed is:

1. A clamping apparatus allowing a downhole line to be fed between downhole tubular members, wherein the clamping apparatus comprises:

a. a clamping apparatus first half comprising:

(i) a first support arm having an inner surface;

(ii) a second support arm having an inner surface, wherein the first support arm is attached to the second support arm by a first connecting wall, and wherein the clamping apparatus first half comprises a first smooth outer surface extending from the first support arm to the second support arm; and (iii) a first grip disposed on a first connecting wall inner surface, wherein the first grip extends from an inner diameter of the first connecting wall and is configured to contact a downhole tubular member;

b. a clamping apparatus second half selectively connectable to the clamping apparatus first half, wherein the clamping apparatus second half comprises:

(i) a third support arm having an inner surface configured to abut the first support arm inner surface, wherein the first support arm and third support arm form a support surface when contacting one another, and wherein the support surface supports an additional downhole tubular member disposed about the downhole tubular member;

(ii) a fourth support arm having an inner surface configured to abut the second support arm inner surface, wherein the third support arm is attached to the fourth support arm by a second connecting wall, and wherein the clamping apparatus second half comprises a second smooth outer surface extending from the third support arm to the fourth support arm, wherein the fourth support arm and second support arm form another support surface when contacting one another, and wherein the additional support surface supports the additional downhole tubular member disposed about the downhole tubular member; and (iii) a second grip disposed on an inner surface of the second connecting wall, wherein the second grip extends from an inner diameter of the second connecting wall and is configured to contact the downhole tubular member, and wherein a space is formed between the downhole tubular member and the first connecting wall, wherein the first space is located between the first support arm or the second support arm and the first grip when the first grip and the second grip are engaged with the downhole tubular member.

2. The clamping apparatus of claim 1, further comprising a first support arm grip disposed on the first support arm.

3. The clamping apparatus of claim 1, further comprising a second support arm grip disposed on the second support arm.

4. The clamping apparatus of claim 1, further comprising a third support arm grip disposed on the third support arm.

5. The clamping apparatus of claim 1, further comprising a fourth support arm grip disposed on the fourth support arm.

6. The clamping apparatus of claim 1, further comprising a first fastener attaching the first support arm and the third support arm.

7. The clamping apparatus of claim 6, further comprising a second fastener attaching the second support arm and the fourth support arm.

8. The clamping apparatus of claim 7, further comprising a second fastener retainer for securing the second fastener to the second support arm or the fourth support arm.

9. The clamping apparatus of claim 6, further comprising a first fastener retainer for securing the first fastener to the first support arm or the third support arm.

10. The clamping apparatus of claim 1, further comprising:

a. a first handle extending from the first support arm to the second support arm; and b. a second handle extending from the third support arm to the fourth support arm.

11. The clamping apparatus of claim 1, further comprising a hinge connecting the first support arm to the third support arm, or the second support arm to the fourth support arm.

12. The clamping apparatus of claim 1, further comprising a latch for connecting the first support arm to the third support arm, or the second support arm to the fourth support arm.

13. The clamping apparatus of claim 1, further comprising a first handle secured to the first connecting wall, and a second handle secured to the second connecting wall.

14. A system for feeding a downhole line between an outer tubular member and an inner tubular member, the system comprising:

a. an outer tubular member disposed about an inner tubular member; and b. a clamping apparatus disposed about the inner tubular member, wherein the clamping apparatus comprises:

(i) a clamping apparatus first half comprising:

(a) a first support arm having an inner surface;

(b) a second support arm having an inner surface, wherein the first support arm is attached to the second support arm by a first connecting wall having a radius of curvature, and wherein the first connecting wall comprises a first smooth exterior surface extending from the first support arm to the second support arm; and (c) a first grip disposed on an inner surface of the first connecting wall, wherein the first grip extends from an inner diameter of the first connecting wall and is configured to contact the inner tubular member; and (ii) a clamping apparatus second half selectively connectable to the clamping apparatus first half, wherein the clamping apparatus second half comprises:

(a) a third support arm having an inner surface configured to abut the first support arm inner surface;

(b) a fourth support arm having an inner surface configured to abut the second support arm inner surface, wherein the third support arm is attached to the fourth support arm by a second connecting wall having the radius of curvature, and wherein the second connecting wall comprises a second smooth exterior surface extending from the third support arm to the fourth support arm; and (c) a second grip connected to an inner diameter of the second connecting wall, wherein a channel is formed between the inner diameter of the second connecting wall and an outer diameter of the inner tubular member, wherein the second grip extends from an inner diameter of the second connecting wall and is configured to contact the inner tubular member, and wherein a space is formed between the inner tubular member and the first connecting wall, wherein the first space is located between the first support arm or the second support arm and the first grip when the first grip and the second grip are engaged with the inner tubular member.

15. The system of claim 14, further comprising a first support arm grip disposed on the first support arm.

16. The system of claim 14, further comprising a second support arm grip disposed on the second support arm.

17. The system of claim 14, further comprising a third support arm grip disposed on the third support arm.

18. The system of claim 14, further comprising a fourth support arm grip disposed on the fourth support arm.

19. The system of claim 14, further comprising a first fastener attaching the first support arm to the third support arm.

20. The system of claim 19, further comprising a second fastener attaching the second support arm to the fourth support arm.

* * * * *